US008713941B2

(12) United States Patent
Glos et al.

(10) Patent No.: US 8,713,941 B2
(45) Date of Patent: May 6, 2014

(54) METHOD FOR OPERATING A MULTI-STEP STEAM TURBINE

(75) Inventors: Stefan Glos, Recklinghausen (DE); Matthias Heue, Bochum (DE); Ernst-Wilhelm Pfitzinger, Mülheim an der Ruhr (DE); Norbert Pieper, Duisburg (DE)

(73) Assignee: Siemens Aktiengesellschaft, München (DE)

( * ) Notice: Subject to any disclaimer, the term of this patent is extended or adjusted under 35 U.S.C. 154(b) by 1043 days.

(21) Appl. No.: 12/528,349

(22) PCT Filed: Feb. 15, 2008

(86) PCT No.: PCT/EP2008/051834

§ 371 (c)(1),
(2), (4) Date: Aug. 24, 2009

(87) PCT Pub. No.: WO2008/104465

PCT Pub. Date: Sep. 4, 2008

(65) Prior Publication Data

US 2011/0005224 A1 Jan. 13, 2011

(30) Foreign Application Priority Data

Feb. 26, 2007 (EP) ..... 07003922

(51) Int. Cl.
*F01K 13/02* (2006.01)

(52) U.S. Cl.
USPC ..... 60/646; 60/677

(58) Field of Classification Search
USPC ..... 60/646, 653, 657, 677–679; 415/115
See application file for complete search history.

(56) References Cited

U.S. PATENT DOCUMENTS

| | | | | | |
|---|---|---|---|---|---|
| 3,898,842 | A * | 8/1975 | Luongo | 60/653 |
| 4,498,301 | A | 2/1985 | Tsubouchi | |
| 4,550,569 | A * | 11/1985 | Isa et al. | 60/657 |
| 5,490,386 | A * | 2/1996 | Keller et al. | 60/660 |
| 5,845,496 | A * | 12/1998 | Bachmann | 60/646 |
| 5,953,900 | A * | 9/1999 | Bannister et al. | 60/775 |
| 2003/0097841 | A1 * | 5/2003 | Endries et al. | 60/671 |
| 2004/0261417 | A1 * | 12/2004 | Yamashita et al. | 60/679 |

FOREIGN PATENT DOCUMENTS

| | | | | |
|---|---|---|---|---|
| CN | 1550644 | A | 12/2004 | |
| DD | 148367 | A1 | 5/1981 | |
| DE | 19823251 | A | 5/1998 | |
| EP | 1473442 | A2 | 11/2004 | |
| EP | 1674669 | A1 | 6/2006 | |
| JP | H08-049507 | A * | 2/1996 | F01D 11/02 |
| JP | 10089086 | A | 4/1998 | |
| WO | WO 9812421 | A1 | 3/1998 | |

OTHER PUBLICATIONS

Communication from Yamaguchi International Patent Office, Jul. 28, 2011, pp. 1-2, 1-5.

* cited by examiner

*Primary Examiner* — Kenneth Bomberg
*Assistant Examiner* — Jonathan Matthias

(57) ABSTRACT

A method for operating a multi-step steam turbine operating in high temperature conditions is provided. The rotor is embodied as a welded construction including a first component and a second component. A coolant is supplied to the steam turbine after an intermediate state when the steam turbine is in the light-load or no-load phase. As a result, the thermal loads in the outflow area of the steam turbine are reduced.

9 Claims, 3 Drawing Sheets

METHOD FOR OPERATING A MULTI-STEP STEAM TURBINE

CROSS REFERENCE TO RELATED APPLICATIONS

This application is the US National Stage of International Application No. PCT/EP2008/051834, filed Feb. 15, 2008 and claims the benefit thereof. The International Application claims the benefits of European Patent Office application No. 07003922.7 EP filed Feb. 26, 2007, both of the applications are incorporated by reference herein in their entirety.

FIELD OF INVENTION

The invention relates to a method for operating a multi-stage steam turbine and to a steam power plant comprising a multi-stage steam turbine, a boiler and a cooling medium supply.

BACKGROUND OF INVENTION

For thermodynamic reasons, it is necessary to increase the fresh steam temperatures in order to increase the efficiency of modern steam turbine plants. At present, steam turbines are designed and produced for fresh steam temperatures of approximately 630° C. and fresh steam pressures of approximately 300 bar. The selection of the materials for the rotor and for the housing plays a significant role. It would appear to be possible to use nickel-based alloys as high-temperature materials for planned fresh steam temperatures of 700° C. The rotor and the housing of a steam turbine suitable for 700° C. could therefore be produced from a nickel-based alloy, though this would be a very expensive solution.

In high-pressure turbine sections, the materials in the vicinity of the inflow region are subjected to extreme thermal loading. In the exhaust steam region of the high-pressure turbine section, the temperature and the pressure of the fresh steam is low in relation to the temperature and the pressure of the fresh steam. It is therefore not imperatively necessary to use the expensive nickel-based alloy in the exhaust steam region.

It is therefore conventional to produce high-pressure turbine sections from different materials. It would thus be possible, for example, for the rotor to be formed as a welded structure, with a nickel-based alloy being used in the fresh steam region and a conventional material being used in the exhaust steam region. This would lead to lower overall production costs. A high-pressure turbine section produced in this way would withstand the loadings which occur in operation. However, the steam temperatures in the exhaust steam region of the high-pressure turbine section are comparatively high during a period of idle operation or low-load operation, as a result of which the conventional material is subjected to too great a thermal loading. This problem occurs in particular during a hot start, since the fresh steam temperatures cannot be arbitrarily reduced in order to limit the thermal loading of the incoming flow.

DD 148 367 describes a method for lowering the work capacity of the steam during a load-shedding process, wherein the solution consists in admixing water to the fresh steam via injection nozzles, thereby reducing the temperature of the steam.

SUMMARY OF INVENTION

What would be desirable is a high-pressure turbine section which is formed from different materials and which is suitable for different load conditions, such as for example low load or high load.

The invention addresses this; it is the object of the invention to specify a method for operating a steam turbine and a steam power plant, with it being possible for the steam turbine to be produced in a cost-effective manner.

The object on which the invention is based is achieved by means of a method for operating a multi-stage steam turbine, with the steam turbine being supplied with fresh steam and, downstream of an intermediate stage, a cooling medium.

The invention is based on the aspect that a high-pressure turbine section can be produced from a conventional material in the exhaust steam region if the exhaust steam region is provided with suitable cooling under idle or low-load operation. This takes place according to the invention by virtue of a cooling medium being supplied downstream of the intermediate stage in the steam turbine. That region of the steam turbine which is situated downstream of said intermediate stage is thereby cooled. That region of the steam turbine which is situated upstream of said intermediate stage may be formed from a nickel-based alloy, with it being possible for the material used in the exhaust steam region to be formed from a conventional material, since the temperatures in the exhaust steam region can now be reduced in a targeted fashion.

Therefore, in contrast to DD 148 367, not all of the fresh steam is cooled by means of the injection of water, but rather only steam which has already cooled and expanded in the steam turbine is cooled further by the cooling medium, as a result of which an abrupt reduction in the temperature of the steam situated in the steam turbine takes place.

The cooling medium is preferably formed from a mixture of propellant steam and water.

This is a comparatively fast and expedient solution for providing a suitable cooling medium since, as a result of the high vaporization heat of the water, the enclosed steam quantity undergoes a significant temperature reduction and therefore also pressure reduction.

The propellant steam is preferably extracted from a boiler. In this way, it is easily possible for the boiler, also referred to as a steam generator, to be retrofitted in an existing steam power plant in order to provide propellant steam.

Alternatively, in a further preferred embodiment, the propellant steam may be branched off from the fresh steam supply via a bypass line. In addition to the branching directly from the boiler, this would be a further simple and cost-effective option for providing suitable propellant steam which, by means of the admixture of water, may be used as cooling medium in the steam turbine.

In one preferred embodiment, the cooling medium is supplied in idle operation or in low-load operation.

The cooling medium is preferably supplied in particular at the commencement of a hot start. During a hot start, the temperature of the materials of the high-pressure turbine section is comparatively high, such that during a hot start, the fresh steam thermally loads the entire high-pressure turbine section. In particular, since the steam turbine is operated at low load during starting and the steam in the outflow region is at a comparatively high temperature, the high-pressure turbine section is subjected to particularly high thermal loading during a hot start.

The cooling medium is preferably supplied during a starting process until a synchronization has taken place and/or a minimum power has been attained. This has the advantage that the high-pressure steam temperature can be kept constant by regulating the cooling medium mass flow.

In a further advantageous refinement, the steam turbine is refined such that an additional cooling medium is additionally supplied downstream of a second stage.

This has the advantage that the outflow region of the high-pressure turbine section is cooled further, as a result of which suitable conventional materials can be used in the outflow region.

Here, the additional cooling medium is preferably branched off from the cooling medium, which is a cost-effective option for retrofitting an existing steam power plant.

In one advantageous embodiment, the additional cooling medium is emitted from a duct formed in a guide blade. In this way, it is possible for additional cooling medium to flow quickly and over a large area, so to speak, into the flow duct of the turbo-machine. Here, the mixture of the additional cooling medium with the flow medium is comparatively thorough, such that an abrupt reduction in temperature takes place.

The object aimed at the steam power plant is achieved by means of a steam power plant, comprising a multi-stage steam turbine, a boiler and a cooling medium supply, wherein the cooling medium supply opens out into the steam turbine downstream of an intermediate stage. The advantages substantially correspond to those mentioned with regard to the method.

The cooling medium supply is preferably flow-connected to the duct and to a water reservoir.

In a further preferred embodiment, the cooling medium supply is flow-connected to a bypass line from a fresh steam supply line and to a water reservoir.

The steam turbine preferably has a second stage which is flow-connected to an additional cooling medium supply.

BRIEF DESCRIPTION OF THE DRAWINGS

The invention will be explained in more detail on the basis of exemplary embodiments which are illustrated in the figures, in which.

DETAILED DESCRIPTION OF INVENTION

Figure 1:
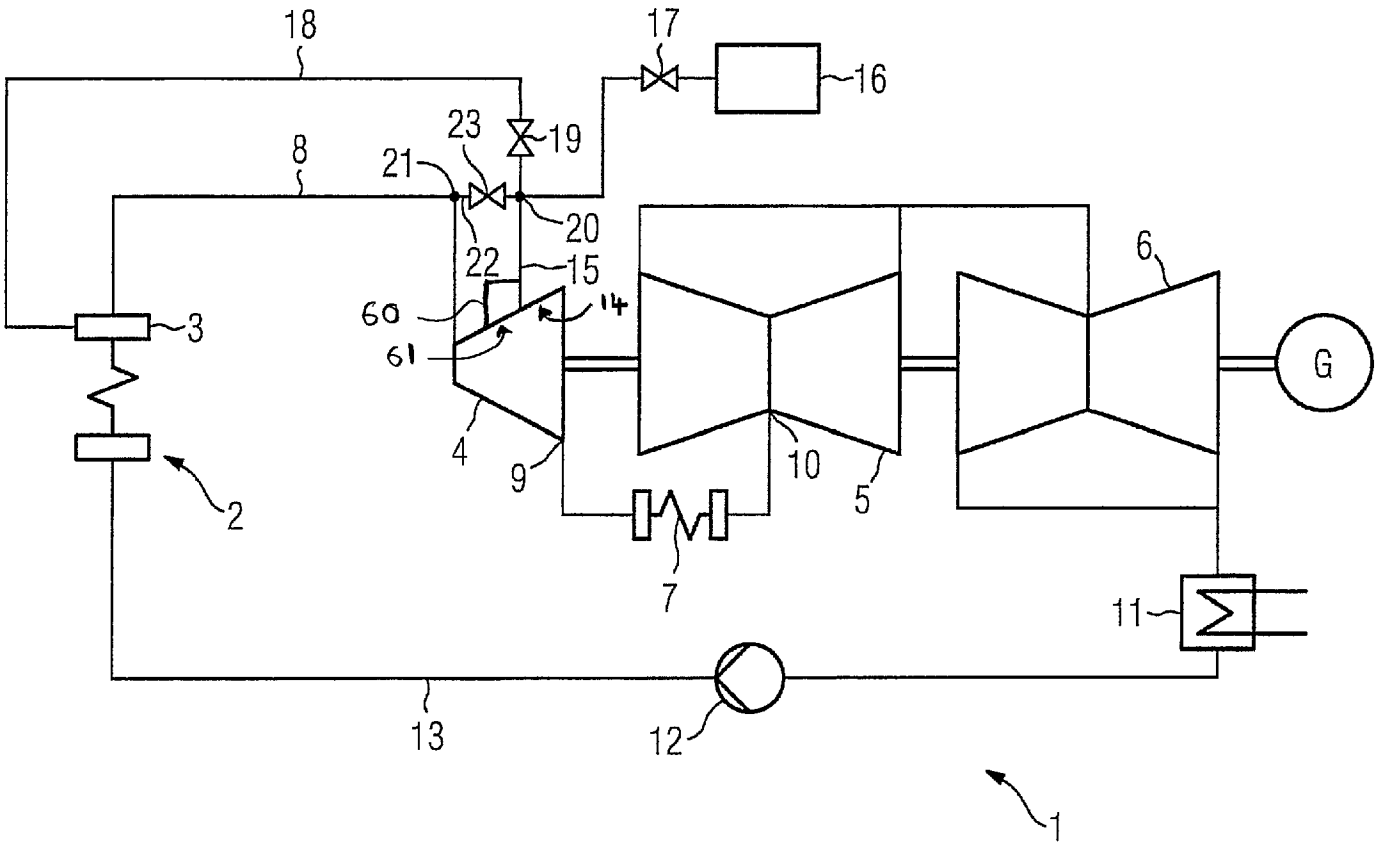
FIG. 1 shows an illustration of a steam power plant.

FIG. 1 shows a steam power plant 1. The steam power plant 1 comprises a steam generator 2. The steam generator 2 may also be referred to as a boiler 2. The steam generator 2 comprises a collecting tank 3 in which the steam can be collected. The steam power plant 1 also comprises a high-pressure turbine section 4, a medium-pressure turbine section 5 and a low-pressure turbine section 6. Among experts, the classification of high-pressure, medium-pressure and low-pressure turbine sections is not defined consistently. There is a DIN standard which defines a high-pressure turbine section 4 as being one in which the steam emerging from the high-pressure turbine section 4 is heated in an intermediate superheater 7 and subsequently flows into a medium-pressure turbine section 5.

In the steam generator 2, fresh steam is generated which is supplied via a line 8 to the high-pressure turbine section 4. The high-pressure turbine section 4, as an embodiment of a steam turbine, comprises a plurality of stages. At the outflow pipe 9, steam flows to the intermediate superheater 7, is heated there and is subsequently conducted to the inflow pipe 10 of the medium-pressure turbine section 5. The steam is expanded further in the medium-pressure turbine section 5, with said steam flowing into the low-pressure turbine section 6 after emerging from the medium-pressure turbine section 5. Downstream of the low-pressure turbine section 6, the steam flows into a condenser 11, where it is condensed to form water.

The condensed water is conducted by means of a pump 12 via a further line 13 to the steam generator 2.

The high-pressure turbine section 4 is operated in such a way that a cooling medium is supplied downstream of an intermediate stage 14. For this purpose, the steam power plant 1 has a cooling medium supply 15 which opens out into the high-pressure turbine section 4 downstream of the intermediate stage 14.

The cooling medium is formed from a mixture of propellant steam and water. The water is extracted from a water reservoir 16, which water may be admixed to the propellant steam by means of a valve 17. The propellant steam is extracted from a branch line 18 which opens out in the collecting tank 3 of the steam generator 2. Fresh steam from the steam generator 2 therefore passes via the branch line 18 and a valve 19 and is mixed with the water from the water reservoir 16 at the junction 20, and is conducted into the high-pressure turbine section 4 downstream of the intermediate stage 14 via the cooling medium supply 15.

In an alternative embodiment, the branch line 18 and the valve 19 may be dispensed with, with the propellant steam from the line 8 being supplied, at the branch junction 21, to the junction 20 via a bypass line 22 and a valve 23.

The mass flow of the propellant steam and of the water may be adjusted by means of throttles (not illustrated in any more detail) and the valves 17, 19, 23. The throttles and/or the valves 17, 19, 23 may be coupled to a control system which regulates the throughflow rate. Here, the regulation may be carried out in such a way that, with progressive time after a minimum load is attained, the throughflow rate is successively reduced and finally completely shut off.

Here, the steam turbine 4 is operated in such a way that the cooling medium is supplied to the high-pressure turbine section 4 in idle operation or in low-load operation.

The cooling medium is supplied during a starting process until a synchronization has taken place and/or a minimum power has been attained. A synchronization is to be understood to mean the synchronization with the mains frequency. A minimum power is to be understood to mean a power at which the high-pressure turbine outputs a sufficient level of power and thus has low exhaust-steam temperatures.

Figure 2:
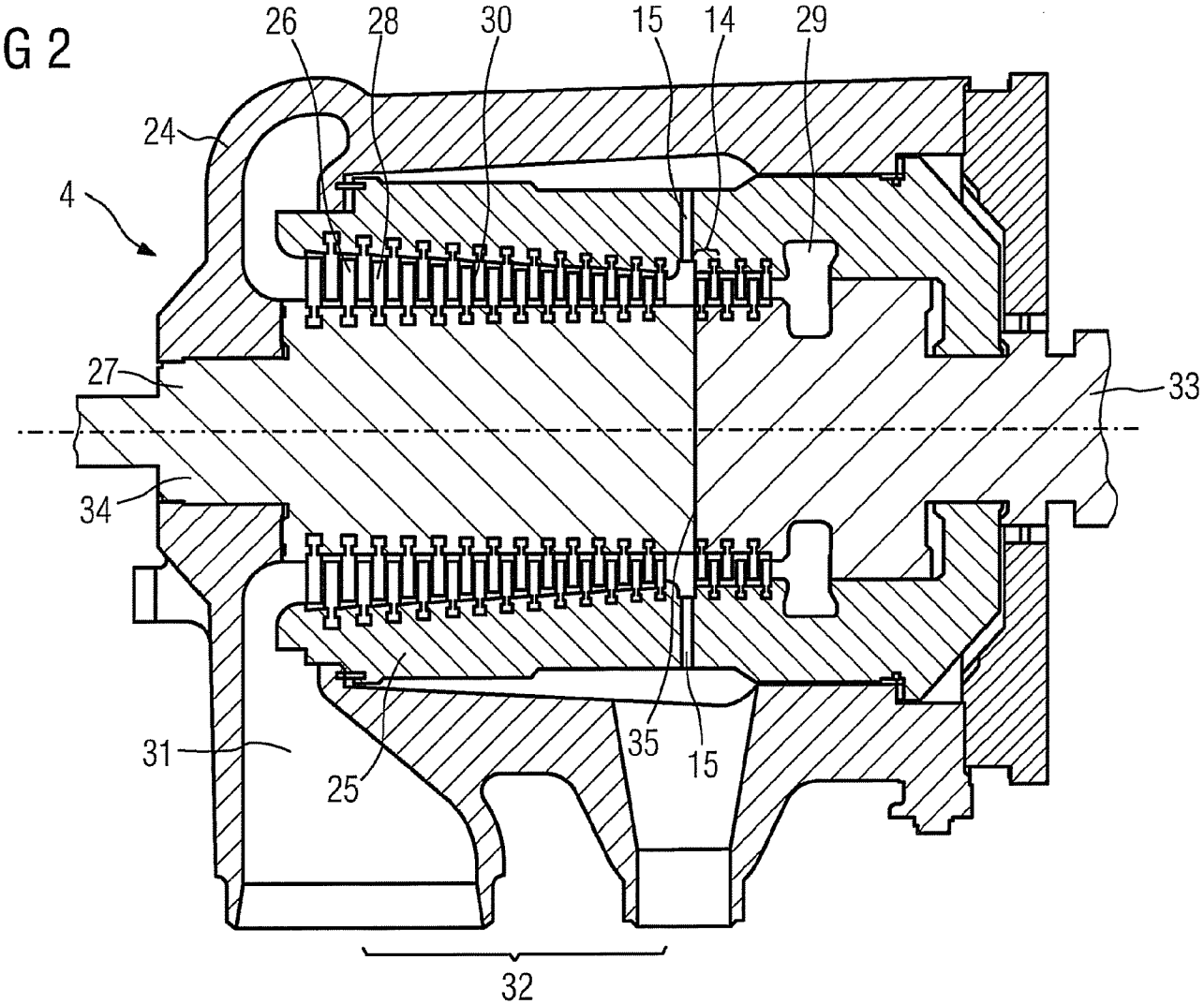
FIG. 2 shows a sectional illustration of a high-pressure turbine section.

FIG. 2 shows a cross-sectional view of the high-pressure turbine section 4. The high-pressure turbine section 4 comprises an outer housing 24 and an inner housing 25. A plurality of guide blades 26 are arranged on the inner housing 25, wherein for clarity, only one guide blade has been provided with the reference numeral 26. A rotor 27 is rotatably mounted within the inner housing 25. The rotor 27 comprises a plurality of rotor blades 28, wherein for clarity, only one rotor blade has been provided with the reference numeral 28. The high-pressure turbine section 4 has a flow inlet 29 into which is supplied the fresh steam from the steam generator 2. The fresh steam which is supplied in this way is conducted through the guide blades 26 and rotor blades 28, with the fresh steam being expanded and the temperature falling. A flow duct 30 is formed between the rotor 27 and the inner surface of the inner housing 25, which flow duct 30 ends in an outflow pipe 31.

The high-pressure turbine section 4 is designed in such a way that a cooling medium supply 15 is arranged such that the cooling medium can be conducted into the flow duct 30 downstream of the intermediate stage 14. The region up to the intermediate stage 14, in particular the region around the flow inlet 29, is subjected to particularly high thermal loading and should therefore be formed from a nickel-based alloy. Cooling of the flow medium in the flow duct 30 takes place as a result of the inflow of the cooling medium via the cooling medium supply 15 downstream of the intermediate stage 14, which cooling causes the temperature to be reduced in the outflow region 32 and therefore makes it possible to use a cheaper material than the nickel-based alloy. The rotor 27 may therefore be produced from two components, wherein the first component 33 may be formed from the nickel-based alloy and the second component 34 may be formed from a cheaper material. The first component 33 and the second component 34 are connected to one another by means of a welded connection 35.

Referring to FIG. 1, the steam power plant 1 may be provided with additional cooling by means of the supply of an additional cooling medium 60 downstream of a second stage 61. The second stage is not illustrated in any more detail in FIG. 2, but is situated downstream of the intermediate stage 14 as viewed in the flow direction as shown in FIG. 1. The additional cooling medium 60 is branched off from the cooling medium 15.

The temperature and pressure of the second cooling medium (i.e., the additional cooling medium) are lower than the temperature and pressure of the first cooling medium (from the supply 15).

Here, the high-pressure turbine section 4 is designed such that the guide blades 26 of the second stage have ducts.

Said guide blades 26 of the second stage are accordingly formed so as to be hollow to a greater or lesser extent, with it being possible for the cavity to be filled with the additional cooling medium. The additional cooling medium flows out of said ducts, out of the guide blades 26 of the second stage, and mixes with the flow medium situated in the flow duct 30. This means that, beyond said point, further cooling of the flow medium takes place downstream of the second stage, and the thermal loading is reduced beyond said point.

High-pressure turbine sections 4 are, in some embodiments, formed with a steam tap pipe. Said steam tap pipes are used as a tap in normal load operation of the high-pressure turbine section 4, with steam being discharged from the flow duct 30 via the steam tap pipe. In idle operation or low-load operation, said steam tap pipe is, in a sense, converted into the cooling medium supply, with the cooling medium passing into the high-pressure turbine section 4 via said steam tap pipe. The steam tap pipe therefore performs a dual function: firstly for discharging steam out of the flow duct 30 in load operation, and secondly for supplying cooling medium during low-load operation or idle operation.

The high-pressure turbine section 4 comprises the second stage, which is flow-connected to an additional cooling medium supply. The additional cooling medium supply is flow-connected to the steam generator 2 and to the water reservoir 16, which is not illustrated in any more detail in FIG. 1.

Figure 3:
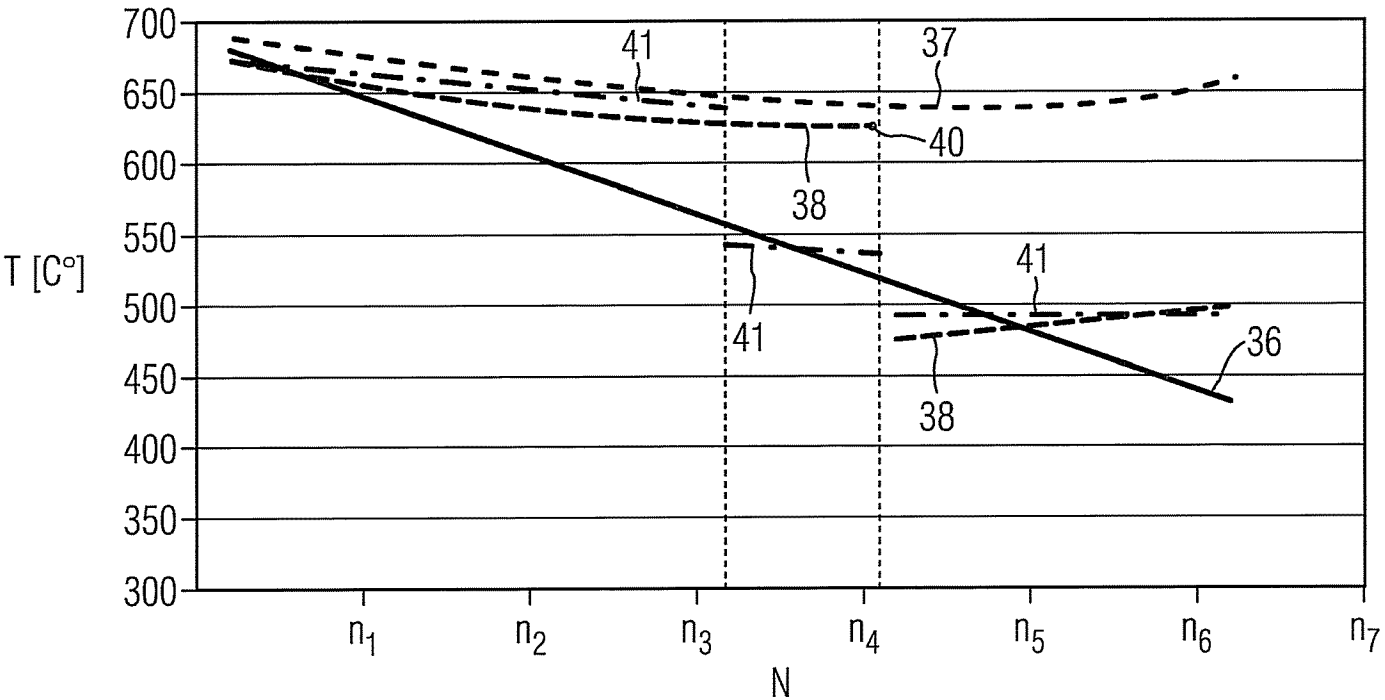
FIG. 3 shows temperature profiles within the high-pressure turbine section.

FIG. 3 illustrates the temperature profile within the high-pressure turbine section 4 as a function of the number of stages N ($n_1$-$n_7$). The stages $n_1$, $n_2$, . . . $n_7$ represent positive integers which correspond to the number of stages. The exact number of stages is not necessary for precise understanding of the invention, for which reason the number of stages has been replaced by the indices 1 to 7. The curve 36 shows the temperature profile as a function of the stages in normal operation. It can be clearly seen that the temperature drops from approximately 700° C. to approximately 420° C. downstream of the stage $n_6$. This takes place as a result of thermodynamic transformations, with the fresh steam being expanded and the temperature being reduced.

The second curve 37 shows the profile of the temperature as a function of the stages N in idle operation or low-load operation if no measures according to the invention are implemented. It can be clearly seen that the temperature barely falls upstream of the stage $n_4$ and even rises again downstream of the stage $n_4$. This means that the stages beyond approximately $n_3$ in the outflow region are subjected to thermal loading since the temperatures there are constantly higher than 600° C. The third curve 38 shows the profile of the temperature T as a function of the stages N in low-load operation or idle operation if the cooling medium is supplied to the high-pressure turbine section 4 downstream of the stage $n_4$, which is to be understood to be the intermediate stage 14. At the vertical dashed line, it is possible to clearly see that the temperature at that point has dropped significantly from approximately 630° C. to 470° C. This means that, beyond said point, the high-pressure turbine section 4 is subjected to a lesser thermal loading since the temperatures in said region do not exceed 500° C.

The fourth curve 41 shows the temperature profile T as a function of the stages N if the intermediate stage 14 is instead provided at the point $n_3$ and the additional cooling medium is additionally supplied at the point $n_4$, downstream of the second stage. It can be very clearly seen that, downstream of the intermediate stage 14, that is to say a short distance after the stage $n_3$ in the illustration of FIG. 3, the temperature drops abruptly from approximately 640° C. to 540° C., and the temperature subsequently falls from approximately 530° C. to 490° C. downstream of the further supply of additional cooling medium.

The invention claimed is:

1. A method for operating a multi-stage steam turbine, comprising:

forming a flow duct from a plurality of stages;

supplying the steam turbine with fresh steam;

supplying a first cooling medium into the flow duct downstream of and adjacent to an intermediate stage; and supplying a second cooling medium downstream of a second stage, wherein the first cooling medium is supplied only in an idle operation or in a low-load operation, and wherein the first cooling medium is formed from a mixture of propellant steam and water, and wherein a first plurality of thermodynamic values of the first cooling medium differ from a second plurality of thermodynamic values of the second cooling medium.

2. The method as claimed in claim 1, wherein the propellant steam is extracted from a boiler.

3. The method as claimed in claim 1, wherein the propellant steam is branched off from the fresh steam supply via a bypass line.

4. The method as claimed in claim 1, wherein the first cooling medium is supplied at a commencement of a hot start.

5. The method as claimed in claim 1, wherein the first cooling medium is supplied during a starting process until a synchronization has taken place or a minimum power has been attained.

6. The method as claimed in claim 1, wherein the second cooling medium is branched off from the first cooling medium.

7. The method as claimed in claim 1, wherein the flow duct is formed between a rotor and an inner housing.

8. The method as claimed in claim 7, wherein the first cooling medium is supplied into the flow duct via a cooling medium supply that is arranged to conduct the first cooling medium into the flow duct through the inner housing.

9. A method for operating a multi-stage steam turbine, comprising:

forming a flow duct from a plurality of stages;

supplying the steam turbine with fresh steam;

supplying a first cooling medium into the flow duct downstream of and adjacent to an intermediate stage; and supplying a second cooling medium downstream of a second stage, wherein the first cooling medium is supplied only in an idle operation or in a low-load operation, and wherein the first cooling medium is formed from a mixture of propellant steam and water, wherein a second temperature and a second pressure of the second cooling medium are lower than a first temperature and a first pressure of the first cooling medium.

* * * * *